US005970937A

United States Patent [19]

Casellato et al.

[11] Patent Number: 5,970,937

[45] Date of Patent: Oct. 26, 1999

[54] DEVICE FOR CONTROLLING A COUPLING ELECTROMAGNET FOR STARTING AN INTERNAL COMBUSTION ENGINE, IN PARTICULAR FOR A MOTOR VEHICLE

[75] Inventors: Giancarlo Casellato; Mario Montuschi, both of Turin, Italy

[73] Assignee: C.R.F. S.C.P.A., Orbassano, Italy

[21] Appl. No.: 08/974,106

[22] Filed: Nov. 19, 1997

[30] Foreign Application Priority Data

Nov. 20, 1996 [IT] Italy ..... TO96A0937

[51] Int. Cl.[6] ..... F02N 11/08

[52] U.S. Cl. ..... 123/179.3; 290/38 R

[58] Field of Search ..... 123/179.3, 179.2, 123/179.4; 701/36; 290/38 R, 38 C; 361/152; 324/207.16

[56] References Cited

U.S. PATENT DOCUMENTS

| | | | |
|---|---|---|---|
| 4,551,630 | 11/1985 | Stahura et al. | 123/179.3 |
| 4,586,467 | 5/1986 | Raver | 123/179.3 |
| 4,774,945 | 10/1988 | Nquyen et al. | 123/179.3 |
| 4,862,010 | 8/1989 | Yamamoto | 290/38 R |
| 4,917,410 | 4/1990 | Cummins et al. | 290/38 R |
| 4,947,051 | 8/1990 | Yamamoto et al. | 290/38 R |
| 5,383,428 | 1/1995 | Fasola et al. | 123/179.3 |
| 5,424,637 | 6/1995 | Oudyn et al. | 324/207.16 |
| 5,481,187 | 1/1996 | Marcott et al. | 324/207.16 |
| 5,578,904 | 11/1996 | Marcott et al. | 324/207.16 |
| 5,583,434 | 12/1996 | Moyers et al. | 324/207.16 |
| 5,600,237 | 2/1997 | Nippert | 324/207.16 |
| 5,622,148 | 4/1997 | Xue et al. | 123/179.25 |
| 5,743,227 | 4/1998 | Jacquet et al. | 123/179.3 |

FOREIGN PATENT DOCUMENTS

| | | |
|---|---|---|
| 0562457 | 9/1993 | European Pat. Off. . |
| 0727577 | 2/1996 | European Pat. Off. . |
| 0727667 | 2/1996 | European Pat. Off. . |

*Primary Examiner*—Tony M. Argenbright
*Assistant Examiner*—Arnold Castro
*Attorney, Agent, or Firm*—Sughrue, Mion, Zinn, Macpeak & Seas, PLLC

[57] ABSTRACT

A control device for a coupling electromagnet in particular for a starter motor for a motor vehicle, operable to regulate the speed of engagement of the pinion of the ring gear in such a way as to avoid stresses wear and noise due to excessive speed of engagement in the initial phase of the starting operation. The device operates in a closed loop with a feedback signal generated by an estimator.

19 Claims, 4 Drawing Sheets

DEVICE FOR CONTROLLING A COUPLING ELECTROMAGNET FOR STARTING AN INTERNAL COMBUSTION ENGINE, IN PARTICULAR FOR A MOTOR VEHICLE

BACKGROUND OF THE INVENTION

The present invention relates in general to coupling devices and more specifically refers to a control device for a coupling electromagnet which can be associated with a starter motor used for starting an internal combustion engine.

As is known the use of electric motors for starting heat engines, in particular internal combustion engines is widely diffused. In the case of internal combustion engines of motor vehicles this starting system has by now in fact become standard.

To start an internal combustion engine by means of an electric starter motor the motor and the engine are coupled by means of gear wheels. On the drive shaft of the starter motor there is fitted a gear wheel commonly called a pinion, whilst on the internal combustion engine's crankshaft there is fitted another gear wheel, called a ring gear, having a decidedly greater diameter than the diameter of the pinion.

By energising the starter motor this, by means of the pinion and ring gear which mesh together, drive the internal combustion engine's crankshaft allowing the engine to start. It is, however, evident that the pinion and ring gear cannot be permanently in mesh with one another. In fact, if this were to happen, once the internal combustion engine had started, it would drive the starter motor at high speed certainly causing damage to the two gear wheels and/or to the starter motor. For this purpose the starter motor is therefore provided with an electromagnet intended to cause engagement of the pinion, which can slide in an axial direction with respect to the ring gear in such a way that the respective teeth only mesh during the starting operation.

This system, although accepted and universally adopted in the motor vehicle sector, is not however free from disadvantages. In fact, the conventional starting systems do not provide any control for the supply of the electromagnets so that the pinion and ring gear are subject to high stresses due to the excessive speed with which the pinion comes into contact with the ring gear. This excessive speed also causes an annoying acoustic noise especially if the teeth of the pinion strike against those of the ring gear. Moreover, since the internal combustion engine tends always to stop in predetermined positions the teeth of the ring gear involved in these impacts tend always to be the same thereby causing localised wear.

Further problems can arise for example if the user, when starting the engine, maintains the starting contacts closed for a period of time greater than necessary, thereby causing excessive wear and overheating of the starter motor.

Some solutions proposed to overcome these disadvantages are known in the art. For example the document EP-A-0 727 577 describes a starter system comprising a device for controlling the speed of translation of the coupling electromagnet using a tachometric sensor for the purpose of detecting this speed of translation. In the document EP-A-0 727 667, there is described an electromagnetic tachometric sensor which can be used in such a starter system.

This arrangement allows an effective control of the speed of translation of the coupling electromagnet to be effected, but is not free from disadvantages. In fact, the use of a tachometric sensor involves a not insignificant increase in the cost and complexity of the system. There are also known arrangements in which this control is effected without a tachometric sensor but by measuring the current in the winding of the coupling electromagnet. For example, in the document U.S. Pat. No. 5 383 428 there is described a starter system comprising an electronic control unit operable to detect the current in the winding of the coupling electromagnet by means of a measurement resistor (or shunt) and to control this current. This measurement resistor is connected to the winding of the coupling electromagnet in that it is constituted by a portion of copper wire constituting a part of this winding. This arrangement however has the disadvantage of not allowing a sufficiently accurate control of the speed of translation of the electromagnet for various reasons which will be discussed in more detail hereinafter.

SUMMARY OF THE INVENTION

The object of the present invention is that of providing a control device for a starter coupling electromagnet which allows all the above-indicated problems to be resolved in a satisfactory manner.

According to the present invention, this object is achieved by a control device having the characteristics indicated in the claims which follow the present description.

BRIEF DESCRIPTION OF THE DRAWINGS

Further advantages and characteristics of the present invention will become evident from the following detailed description given with the aid of the attached drawings, provided by way of non-limitative example, in which.

DETAILED DESCRIPTION OF THE INVENTION

The present invention thus consists substantially in a control device for a starter coupling electromagnet having the function of controlling the speed of actuation of the electromagnet itself for the purpose of eliminating the disadvantages described above.

Figure 1:
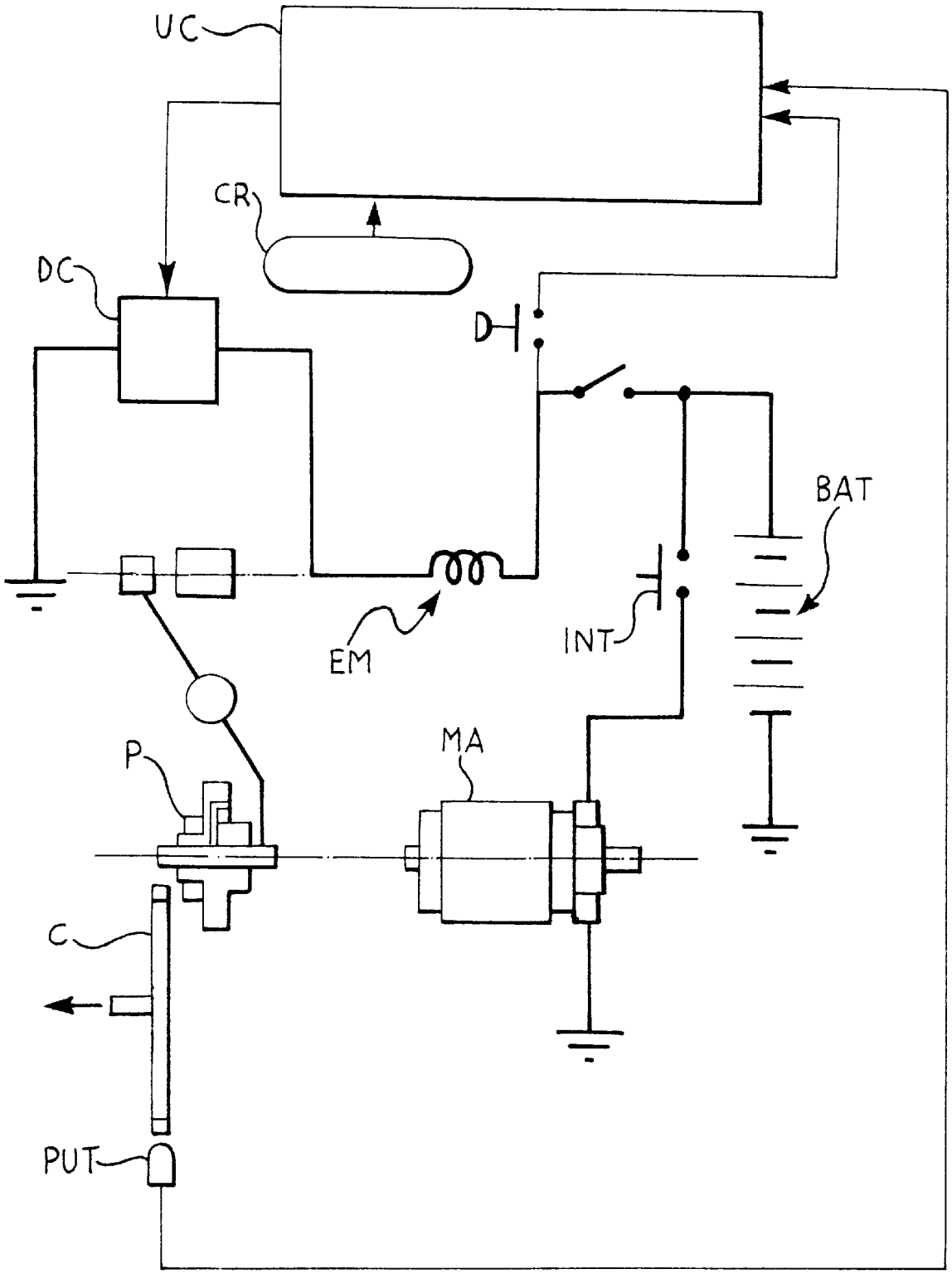
FIG. 1 is a block schematic representation of a starter system including a device according to the present invention.

In FIG. 1 there is shown a block schematic diagram of a starting system for an internal combustion engine, including a control device of the type according to the present invention.

The system naturally comprises an electric starter motor MA on the drive shaft of which is fitted a pinion P. The pinion P can slide on its axis in such a way as to mesh with the ring gear C or disengage from such meshing engagement. The ring gear C is connected to the drive shaft of the internal combustion engine to be started (not illustrated). Normally the pinion P and the ring gear C are connected, that is to say in mesh with one another, only during the starting phase whilst for the remainder of the time they are unconnected, that is to say not in mesh.

Typically the pinion P is caused to slide on its axis in such a way as to mesh with the ring gear C by means of a lever controlled by a coupling electromagnet EM. The electromagnet EM is usually of the suck-in movable core type. The movable core of the electromagnet EM moreover controls a switch INT through which the starter motor MA is fed. In this way the electromagnet EM, after having caused the working stroke with possible meshing of the pinion P with the ring gear C, also causes the starter motor MA to be fed. Naturally both the electromagnet EM and the starter motor MA, like the entire remainder of the components of the starting system, are fed from an electrical accumulator battery BAT. This type of starting system is widely known and is classical for vehicles driven by an internal combustion engine.

In the case of the present invention the electromagnet EM is no longer fed, as in the prior art, simply by closing a switch, for example by means of the ignition key of the vehicle, but is fed by means of a switch device DC. The switch device DC, which is controlled by an electronic control unit UC, acts to control the supply current to the electromagnet EM. In this way the control unit UC can control the speed of operation of the electromagnet EM and consequently the engagement of the pinion P with the ring gear C.

In the present embodiment the control unit UC is constituted by an electronic circuit and the switch device DC is constituted by a semiconductor switch device, for example a transistor of MOSFET type.

According to the invention the control unit UC is configured in such a way as to perform a control process of closed loop type. The control unit UC must therefore be provided with a module CR operable to provide a feedback signal indicative of the speed of actuation of the electromagnet EM. The objective of the control unit UC is, in fact, that of controlling the speed at which the movable core of the electromagnet EM moves, for which reason the feedback signal provided by the module CR must be a signal indicative of the speed of translation of the movable core itself.

The control unit UC will now be described in greater detail. As mentioned above, the control unit UC operates in a closed loop. The control unit UC regulates the current through the electromagnet EM in such a way that its movable core translates at a predetermined speed. This type of closed loop control is well known in the art and, as already mentioned, requires a signal indicative of the effective speed of the movable core of the electromagnet EM.

Figure 2:
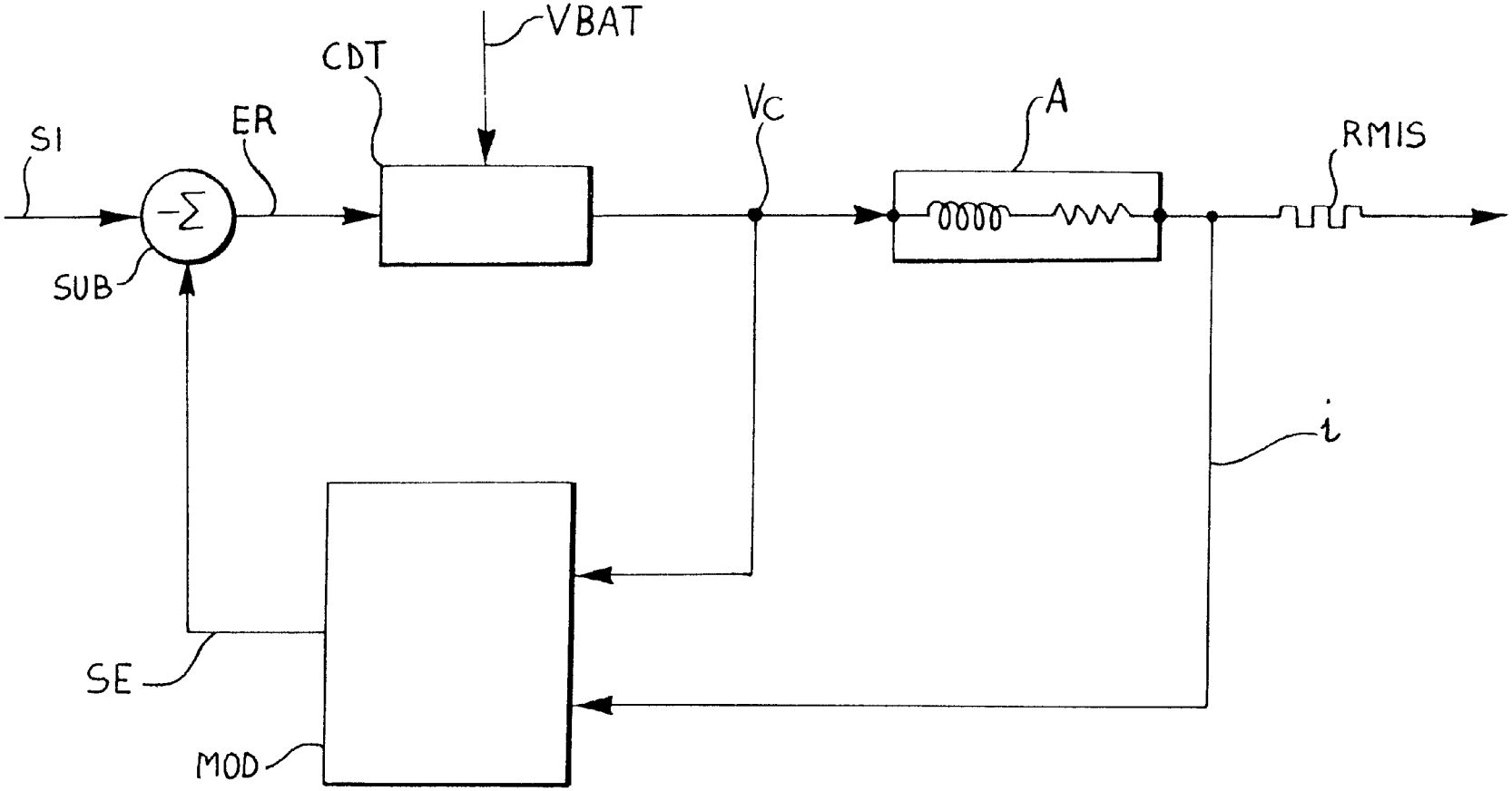
FIG. 2 is a block schematic representation of the control device according to the present invention.

The effective speed of the core can be estimated by means of a model. In FIG. 2 there is shown a functional block diagram of an embodiment of the device according to the present invention using an estimator.

In this embodiment the control unit UC comprises a voltage control module CDT, fed with the battery voltage VBAT, operable to control the supply voltage Vc of a winding A of the electromagnet EM. The voltage control module CDT operates on the basis of an error signal ER generated by a subtraction node SUB. The subtraction node SUB receives a signal SI indicative of the desired speed of the core from which is subtracted a feedback signal SE indicative of the effective speed of the core. This type of control, known in the art, thus makes it possible to set the desired speed of the core (signal SI) which the system then seeks to achieve and maintain.

To generate the feedback signal SE there is used an estimator MOD using a model operable to estimate the effective speed of the movable core.

In series with the winding A of the electromagnet EM there is disposed a measurement resistor RMIS (also called a shunt) by means of which it is possible to take off a signal i indicative of the current through the winding A. This signal i is applied to the input of the estimator module MOD, together with a signal Vc indicative of the supply voltage of the winding A. The estimator module MOD uses a model of the electromagnet EM, and is configured in such a way as to calculate, starting from the signals i and Vc, the effective speed of the core. The estimator module MOD thus generates the signal SE indicative of the effective speed of the core. The signal SE is provided to the subtraction node SUB.

In order to be able to produce the present invention it has been necessary to perform a characterisation of the winding A of the coupling electromagnet EM associated with the starter motor MA. The objective of this characterisation was to determine an equivalent electric circuit of the winding A necessary for subsequent processing of a control methodology.

For this purpose a mapping of the total static magnetic flux was made, and thus therefore also the static inductance of the winding A for different excitation currents and for different positions of the movable core of the electromagnet EM. The equivalent circuit in static conditions is constituted by an ideal resistance and an ideal inductance connected in series as shown in FIG. 2.

In dynamic conditions, variation in the position of the core and variation in the current i in the winding A corresponds to a flux variation less than the static values referred to the said position and current i given that a part of the magnetic flux itself is "short circuited" by parasitic currents which, in dynamic conditions, arise in the mass of the core and in the "stator" of the winding A.

Figure 3:
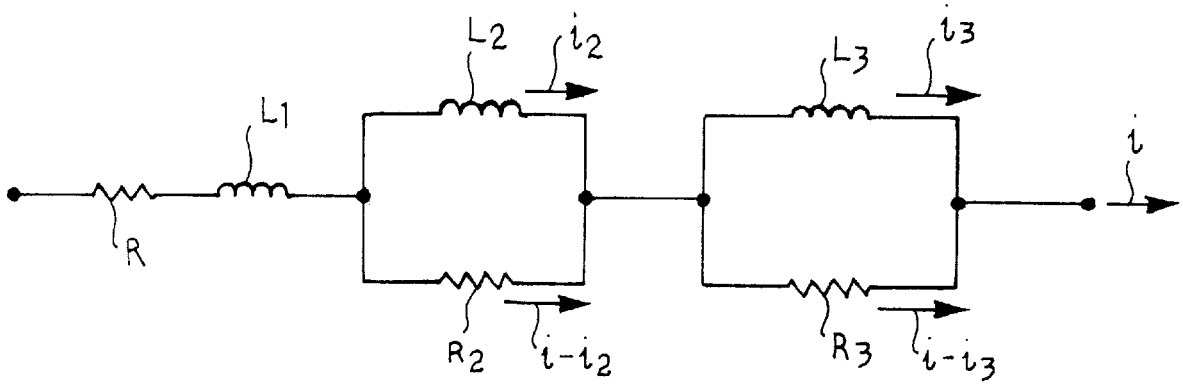
FIG. 3 is a schematic circuit representation of a component of the starter system of FIG. 1, illustrating the principle of operation of the control device according to the present invention.

Tests have made it possible to detect with a good approximation the dynamic components of the winding A. The resultant equivalent circuit is therefore that represented in FIG. 3, in which:

R is the resistance of the winding A, $L_1$ is the inductance due to the flux in air and in the outer skin of the magnetic system, $L_2$ is the deeper inductance of the magnetic system, associated with a resistance $R_2$ on which the associated parasitic currents close, $L_3$ is an inductance relative to the inner part of the magnetic system, associated with a resistance $R_3$ on which the associated parasitic currents close.

The inductances $L_1$, $L_2$, $L_3$ are functions of the position of the movable core, the current i and, to a certain extent, the time t. It can be seen from the circuit that the current i which produces a magnetic flux $\Phi=Li$ completely traverses the inductance $L_1$ but not the inductances $L_2$ and $L_3$. One therefore has that:

$$\Phi_{din}=\Phi_{1din}+\Phi_{2din}+\Phi_{3din}=iL_1+i_2L_2+i_3L_3$$

where $i_2$ and $i_3$ are dynamic currents in the inductances $L_2$ and $L_3$. The procedure for deriving the inductances $L_1$, $L_2$, $L_3$ and the resistances $R_2$, $R_3$ of the equivalent circuit was based on detection and analysis of the voltage waveform which is generated across the terminals of the winding A as a response to a current ramp at different values of di/dt.

A voltage v, detected across the terminals of the winding A was the summation of three voltages $v_1$, $v_2$, $v_3$ and was broken down into its three components by determining the values of $L_1$, $L_2$ and $L_3$ and two time constants $\tau_2$, $\tau_3$ and therefore, indirectly, of the resistances $R_2$ and $R_3$.

The determination was made for different currents and "static" positions with small excursions of di/dt to alter slightly the value of the starting current. Both a rising and a falling current ramp were used leaving the associated dynamic phenomena to settle sufficiently between one ramp and the next. This series of tests allowed determination of $L_1$, $L_2$, $L_3$ and $R_2$, $R_3$ for every combination of current i and position. The total instantaneous magnetic flux $\Phi_{din}$ is then:

$$\Phi_{din}=(L_1+L_2+L_3)i+L_2K\tau_2(e^{-t/\tau_2}-1)+L_3K\tau_3(e^{-t/\tau_3}-1)$$

for an excitation di/dt=K and an instantaneous current i, K being a constant.

As mentioned, the control device operates in a closed loop by utilising a feedback signal SE indicative of the speed of the core of the electromagnet EM. This speed can be estimated by using the model of the total instantaneous magnetic flux $\Phi_{din}$. The mappings of the total instantaneous magnetic flux can be derived by parametrisation of the winding A. Transfer of these mappings into analytical form provides a general equation of the flux:

$$\Phi=f(x,\ i,\ di/dt,\ t)$$

in which x is the position of the core.

Applying to the winding A at each instant a voltage Vc, by operation of the switch device DC, this voltage Vc is balanced by a resistive voltage drop and by a dynamic voltage:

$$Vc=iR+Vd$$

where iR is the resistive voltage drop, or component, and Vd is the dynamic voltage drop or component.

If the effective speed of the core is called w, one has that:

$$w=\frac{Vd-\frac{\delta\Phi}{\delta t}\frac{di}{dt}-\frac{\delta\Phi}{\delta(\delta i/\delta t)}\frac{di^2}{dt^2}}{\delta\Phi/\delta x}$$

and therefore, by combining with Vd=Vc−iR one has that:

$$w=\frac{Vc-iR-\frac{\delta\Phi}{\delta t}\frac{di}{dt}-\frac{\delta\Phi}{\delta(\delta i/\delta t)}\frac{di^2}{dt^2}}{\delta\Phi/\delta x}$$

w is therefore the term which the estimator MOD must calculate instant by instant and which must be utilised as the feedback signal SE in the control device. To a first approximation, neglecting the dependence on di/dt of the model, one has:

$$w\cong\frac{Vc-iR-\frac{\delta\Phi}{\delta t}\cdot\frac{di}{dt}}{\delta\Phi/\delta x}$$

This method, however, involves various problems. It is necessary, for example, to introduce a plausible value of the position x into the model. To a first approximation, supposing that the control device works in a satisfactory manner, the speed w would have to be reasonably constant. It would therefore have to be possible to estimate the position x by integrating the reference signal for the speed w. A calibration point of the position x is therefore necessary to overcome the uncertainty of values due to the difference between individual production windings.

The control device must moreover treat very complex quantities which vary with time. The ohmic resistance R of the winding A is known in an approximate manner and moreover varies with temperature. Calculations of differentiation, multiplication, division which cannot be effected in a very precise and fast manner simultaneously are necessary. This is also aggravated if the current i through the electromagnet EM should be controlled in pulse width modulation as typically happens these days for the purpose of reducing costs.

Moreover, given the very low speed at which it is desired to control the core of the electromagnet EM, the dynamic term Vd of the voltage Vc is certainly very small so that the estimation of the speed w carries the risk of being very imprecise.

For the purpose of overcoming these disadvantages it was decided to estimate the speed w as the derivative of the estimated position x. The distance travelled, or position, x by the core can be estimated by measurement of a parameter sensitive to the distance x travelled.

Given the theoretical relative ease of measurement it was decided to utilise an inductance $L_1$*, close to the inductance $L_1$ of the equivalent circuit described above. The variation of the inductance $L_1$* (i, x), at a measurement frequency of 5 kHz, is represented in an indicative manner for several values of the current i in FIG. 4. The measurement of the inductance $L_1$* can be made, in an almost continuous manner, in the inactive intervals in the case of pulse width modulation control of the electromagnet EM.

To this end a current pump can inject a current of the order of 100 mA effectively at the frequency of 5 kHz in the winding A. At this frequency the inductance involved is practically only the inductance $L_1$*. By means of the mappings defining the inductance $L_1$*=f(i, x) and the current i measured by means of the measuring resistor RMIS, it is therefore possible to determine the position x. The position x thus derived provides the estimated speed w.

Figure 4:
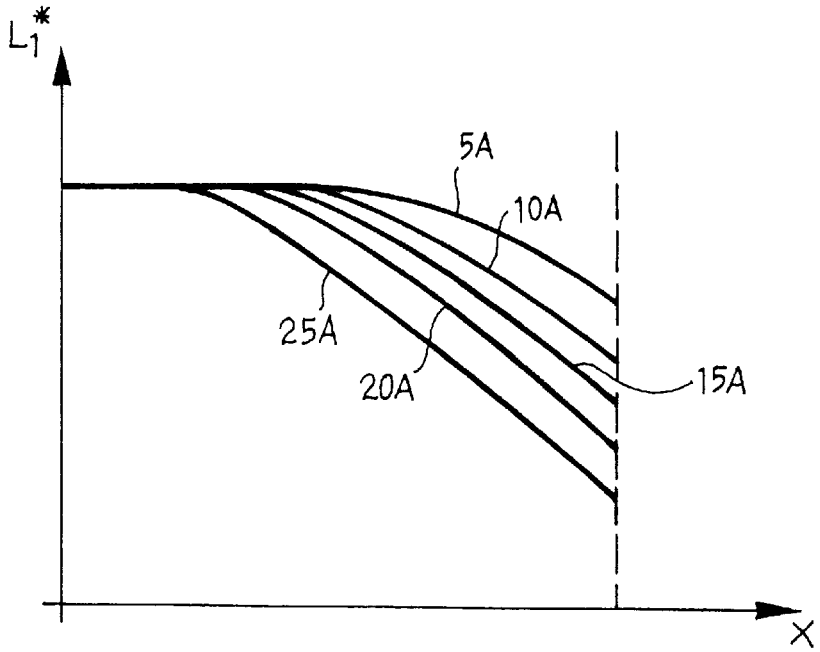
FIG. 4 is a Cartesian diagram illustrating an operating characteristic of the component of FIG. 3.

As can be seen from the diagram of FIG. 4, the inductance $L_1$* varies very little in the first part of the path of the core. In this region of the stroke it is therefore necessary to estimate the speed w which has been reached in another way. Since, however, in this region the core is still a long way from the end of stroke it is possible to accept a less precise control of its speed w.

The system used is as follows: the winding A, which has a resistance R, is fed with a given voltage Vc and consequently a current i flows in it. In each instant the voltage is given by Vc=iR+Vd, this voltage Vc is given by the resistive drop iR plus a feedback voltage, or dynamic voltage Vd. This feedback voltage Vd is essentially constituted by two components: one component is that due to the self inductance, that is to say to the inductance of the coil of the winding A, and is an induction voltage, and the other component is due to the counterelectromotive force originated by the fact that the core moves, and is a kinetic voltage.

In electric motors this phenomenen is utilised, in a technique called resistive compensation or iR compensation, to regulate the speed of the motors themselves. In such motors, however, the counter electromotive force is predominant with respect to the inductive voltage drop which is practically negligible.

In this case on the other hand there is a very great inductive voltage drop. This therefore gives rise to a problem due to that fact that the kinetic component, hereinafter called Ve, that is to say the parameter which it is necessary to isolate and extract from the system in order to be able to utilise it in the control of the speed, is very small.

Supposing, for example, that there is a supply voltage Vc of 12 volts, a resistive voltage drop iR which is in the region of 6–7 volts (or more), an inductive voltage drop of about 3 volts, and a kinetic voltage drop Ve of about 2 volts. It can therefore be seen that the kinetic component Ve is very small, and being small it is difficult to control.

One possibility for eliminating this disadvantage is that of not pretending that the core of the electromagnet EM displaces very slowly, if one can accept the fact that the core moves at a higher speed than that which it could reach in an arrangement which utilises a tachometric sensor. If the core displaces at a higher speed there is obtained a higher kinetic voltage Ve due to the higher counterelectromotive force and therefore one can achieve a more controllable system.

One disadvantage is the fact that the resistive voltage drop iR is always high. That is to say the resistive compensation must be very reliable, otherwise any error involves a gross error in the estimated speed. In practice the core of the electromagnet EM does not move at all if the control is over compensated or, if the control is under compensated, the core moves too rapidly. This occurs because a small error in the resistive compensation involves a large error in the kinetic component Ve even if this component is relatively large, for example 3 volts instead of 2 volts.

Figure 5:
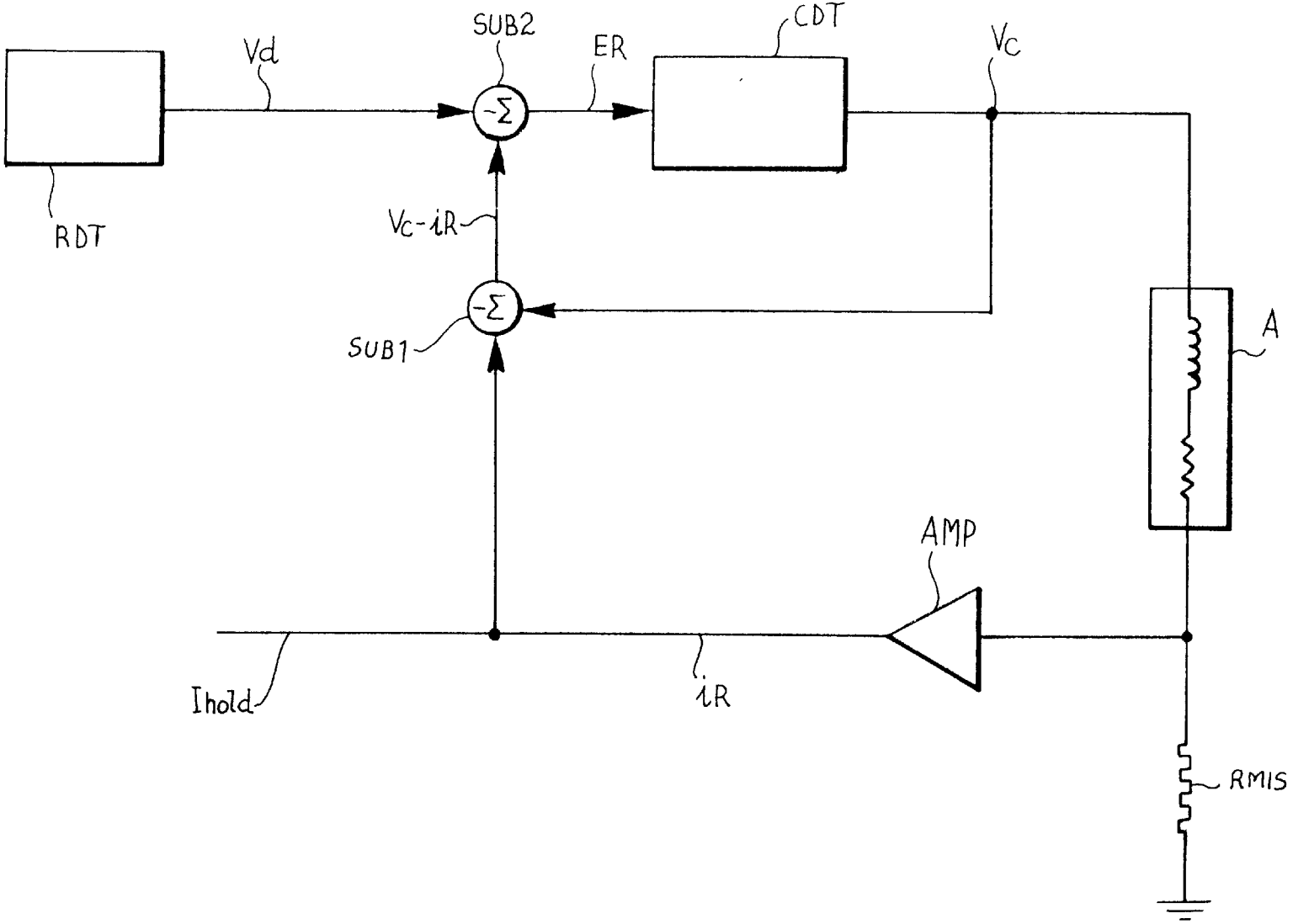
FIG. 5 is a more detailed block schematic representation of the control device of FIG. 2.

The control system utilised in the present invention is illustrated in greater detail in FIG. 5. As can be seen the same elements illustrated in the overall scheme of the control system of FIG. 2 are present. These elements are the voltage control modules CDT, the winding A of the electromagnet EM and the measurement resistor RMIS. The estimator module MOD is however illustrated in greater detail.

The winding A is supplied by a control voltage Vc and through it therefore flows a current i. This current i is measured by means of the measurement resistor RMIS connected in series with the winding A. The voltage detected on the measurement resistor RMIS is amplified by an amplifier AMP having a gain equal to the ratio between the resistance R of the winding A and the resistance of the measurement resistor RMIS. At the output of the amplifier AMP there is therefore a signal equal to the resistive voltage drop iR which appears on the winding A.

This signal iR, indicative of the resistive voltage drop on the winding A, is subtracted from the control voltage Vc detected on the winding A in a subtraction node SUB1. At the output from the subtraction node SUB1 there is therefore a signal Vc–iR corresponding to the dynamic voltage drop or dynamic component which occurs in the winding A.

The control itself is effected on this dynamic component Vc–iR. In fact the reference signal at the input to the control system is really a signal Vd indicative of the dynamic voltage drop, or dynamic component, desired. This dynamic component Vd enters a second subtraction node SUB2 where the signal Vc–iR is subtracted to generate an output error signal ER. The error signal ER is supplied to the input, as described above, of the control module CDT. The control module CDT essentially considerably amplifies the error signal ER and generates the control voltage Vc at its output in such a way as to seek to nullify the error signal ER as in the classic closed loop control systems. The control system therefore tends to impose the equation:

$$Vd=Vc-iR$$

or rather to render the detected dynamic component Vc–iR equal to the reference signal Vd indicative of the desired dynamic component. The equation is in fact verified exactly when the error signal ER, which the control system seeks to zeroise, is nil. The control system in practice acts on the dynamic component Vd in that the resistive term iR is eliminated. The system therefore performs a resistive compensation.

However, as is seen above, the dynamic component Vd is in turn formed by an inductive component and by a kinetic component Ve. The kinetic component Ve is in reality the quantity which one is interested in controlling, in that it is indicative of the speed of translation w of the core of the electromagnet EM. This kinetic component Ve can be isolated, or derived, by means of the differential equations discussed above. However, even by utilising an accurate mathematical model such as that described above, the kinetic component Ve cannot be isolated with precision. In practice it is not possible to estimate the kinetic component Ve precisely.

Nevertheless, the control system just described is configured in such a way that there is an intrinsic compensation of the two components, kinetic Ve and inductive. If in fact one of the two components if preponderant with respect to the other the control, which is effected on the dynamic component Vd, given by the sum of the two components, tends to reduce in a large measure the preponderant component with respect to the other. The control system thus configured tends therefore intrinsically to balance the two components.

For the purpose of overcoming the disadvantage relating to the low precision with which the kinetic component Ve can be detected, the control system according to the present invention employs a reference signal Vd for the dynamic component which is variable in time.

In FIG. 5 there is therefore illustrated a module RDT operable to generate a time varying reference signal Vd indicative of the desired overall dynamic component. This reference signal corresponds therefore to the signal SI indicated in the basic block diagram of the control signal illustrated in FIG. 2. More specifically, the reference signal Vd generated by the module RDT is a voltage ramp, that is to say a signal which increases gradually in time.

In this way the disadvantage due to the lack of precision with which it is possible to derive the kinetic component Ve forming part of the overall dynamic component Vc–iR is overcome. In fact, if the reference signal Vd had a value which was too small, for a given kinetic component Ve, it would not be sufficient to cause the core of the electromagnet EM to move and it would therefore remain stationary. If, on the other hand, the value chosen for the dynamic component Vd were too large the core of the electromagnet EM would move sharply at an excessive speed.

By utilising a ramp reference signal Vd instead it is certain that the core starts to move in a gradual manner. This takes place when the value of the signal Vd is sufficiently high to cause movement of the core. Since the ramp of the reference signal Vd has a low slope it can be certain that the core of the electromagnet EM starts to move in a gradual manner and does not reach excessive speed. In practice, given the lack of precision with which the kinetic component Ve of the dynamic voltage drop Vc–iR is known, the ramp of the reference signal Vd allows the control voltage Vc to pass through all the possible states until reaching that at which the core starts to move. In this way it is therefore possible to avoid impacts and excessive speed of the core itself.

The ramp is naturally dimensioned around an ideal value which the reference signal Vd would have to have in the case of a perfect system. The slope of the ramp is on the other hand chosen in such a way that even in the worst case the speed of the core would not become excessive.

A further characteristic of the present invention is the manner in which the measurement resistor RMIS is formed.

This measurement resistor RMIS must be sensitive to the temperature of the coil of the winding A. In fact upon variation in the temperature of the winding A its resistance R varies and therefore the resistive term iR varies.

In some devices according to the prior art the measurement resistor is located, for the purpose of obtaining a more precise detection, in the coil of the winding A. However the measurement resistor, for practical reasons, must be located close to the surface of the coil of the winding A. In this position it is able only to detect the initial temperature of the coil of the winding A, that is to say the temperature at which the coil finds itself before being fed with current. In fact, when the coil starts to heat up the temperature within it rises very much more rapidly than in the surface region so that a measurement resistor located in this position is not able to detect with precision the temperature of the coil of the winding A. Consequently the resistive compensation is less precise and the performance of the control device degrades. In fact, after the coil of the winding A has been supplied with current for a short time period its temperature is greater than that of the measurement resistor RMIS the operation of which therefore becomes imprecise.

In the control device according to the present invention the measurement resistor RMIS is located in the control electronics which is close to the winding A. The measurement resistor RMIS therefore assumes the temperature of the environment in which the winding A is located. Moreover the measurement resistor RMIS is formed in such a way that when it is fed it heats up like the coil of the winding A. The measurement resistor RMIS is therefore formed in such a way as to be a thermal model of the coil of the winding A.

This can be achieved, for example, by suitably dimensioning the measurement resistor RMIS (thickness of wire, number of turns, length, diameter etc) and/or by giving it an insulating cladding (for example of ceramic material) in such a way that it simulates the thermal behaviour of the winding A when both are fed with current. The measurement resistor RMIS is therefore formed in such a way that the curve of the temperature rise in the measurement resistor RMIS matches the curve of the temperature rise in the winding A on average.

This measurement resistor RMIS can moreover be utilised to provide a switch device which acts when the winding A reaches a certain temperature by interrupting the current supply to the electromagnet EM. This contrivance serves to disconnect the starter motor MA, as in the preceding case, to avoid damage by overheating in the case of excessively prolonged starting, and at the same time avoids the complete discharge of the battery BAT in the case in which the internal combustion engine refuses to start, for example because of carburation anomalies, and the user persists excessively in trying to start.

The same measurement resistor RMIS is moreover utilised to measure a holding current indicated Ihold in FIG. 5 when the starter motor MA is already engaged and in motion. This is useful in that, once the movable core has reached the end of its stroke, it is sufficient that the control device maintains the core in the position reached by controlling the current in the winding A, and limiting the power dissipation therein, especially when starting is prolonged.

This is advantageous in that it makes it possible to utilise electromagnets EM having single windings in place of the double-winding electromagnets used in the prior art, in which the second winding intervenes at the end of the stroke with a maintenance force corresponding to a relatively low current (and therefore heat dissipation).

In an embodiment at present considered preferential, the control unit UC is moreover connected to a sensor PUT, visible in FIG. 1, operable to provide a signal indicative of the speed of rotation of the internal combustion engine. The sensor PUT can for example be an electromagnetic sensor associated with a phonic wheel, typically already present in internal combustion engines installed on vehicles currently in production. This signal allows the control unit UC to detect the starting of the internal combustion engine, which can be considered to have happened when the speed of rotation exceeds, for a certain time, a predetermined threshold for example 1000 revolutions per minute. Once the starting of the internal combustion engine has been detected the control unit UC interrupts supply of the electromagnet EM to disactivate the starter motor MA and disengage the pinion P from the ring gear C.

The control unit UC can moreover be interfaced with an engine management computer (not illustrated) for the internal combustion engine. This connection can serve multiple objectives, for example for the exchange of signals and information between the engine management computer and the control unit UC for automating the starting operation, to implement diagnostic functions, to integrate the engine management computer and the control unit UC etc.

The control device according to the invention, moreover, can conveniently be made in such a way as to operate with pulse width modulation. To effect this type of control of the current i in the winding A of the electromagnet EM it is possible, for example, to utilise a transistor of MOSFET type as the switch device DC. The MOSFET transistor can be piloted, for example, by a comparator circuit having hysteresis which acts with pulse width modulation control. The comparator having hysteresis naturally operates on the basis of the error signal ER.

The device according to the invention therefore makes it possible to obtain numerous advantages the main ones of which are the low speed of impact of the pinion P against the ring gear C and the considerable economy of the device due to the absence of speed sensors and other additional components with respect to the prior art. This consequently limits the noise and mechanical wear of these components thus generally improving the reliability and durability of the starter system.

The device according to the invention also allows the possibility of automating the starting operation with consequent overall improvement in the image of the product and technical advantages due for example to the reduction of emissions caused by the false starts which are possible with prior art systems.

As already mentioned the device according to the invention makes it possible to simplify the production of the winding A of the electromagnet EM by eliminating the holding winding commonly used to maintain the movable core in its end-of-stroke position. This allows a reduction in costs of the electromagnet EM and a lower sensibility to production parameters also thanks to the fact that it is possible to use higher holding currents.

Naturally, the principle of the invention remaining the same, the details of construction and the embodiments can be widely varied with respect with what has been described and illustrated without by this departing from the ambit of the present invention as defined in the appended claims.

What is claimed is:

1. A device for controlling the speed of a coupling electromagnet operable to cause meshing of a first gear wheel with a second gear wheel by a translation of said first gear wheel comprising:

detector means operable to generate a signal indicative of the effective speed of translation of the electromagnet on the basis of detected electric parameters of said electromagnet, processor means receiving at its input said signal indicative of said effective speed of translation, and a reference signal indicative of a predetermined reference speed of translation, switch means controlled by said processor means, operable to control the flow of current in said electromagnet, said processor means being configured to control the supply current to said electromagnet in such a way as to render said effective speed of translation substantially equal to said predetermined reference speed, generator means being provided to generate said reference signal indicate of the predetermined reference speed of translation, configured in such a way as to generate a reference signal which gradually increases in time, wherein said detector means comprise an estimator operable to generate a voltage signal indicative of the effective speed of translation of a movable core of said electromagnet, wherein said estimator operates on the basis of said electrical parameters, said electrical parameters comprising the supply voltage of a winding of said electromagnet and a current flowing in said winding, and wherein said estimator is configured in such a way as to detect a kinetic component of said supply voltage, indicative of said effective speed of translation.

2. A device according to claim 1, wherein the said generator means are configured to generate the said reference signal with an increasing ramp form.

3. A device according to claim 2, wherein said generator means are configured to generate said ramp reference signal with a slope such as to control the speed of translation of said electromagnet.

4. A device according to claim 1, wherein the said estimator is configured in such a way as to detect the said kinetic component by means of a dynamic model of the said winding mapped as a function of time and position assumed by the said electromagnet, detected in an experimental manner in a preliminary phase.

5. A device according to claim 1, wherein the said estimator is configured in such a way as to effect a compensation of the ohmic resistance of the said winding.

6. A device according to claim 1, wherein the said detector means comprise a measurement resistor connected in series to the said winding, operable to detect the said current flowing in the said winding.

7. A device according to claim 6, wherein the said measurement resistor is formed and dimensioned in such a way as to simulate the thermal behaviour of the said winding.

8. A device according to claim 7, wherein the said measurement resistor is formed and dimensioned in such a way that its temperature has a variation with time substantially identical to the variation with time of the temperature of the said winding when both are fed with current.

9. A device according to claim 6, wherein the said measurement resistor is located close to the said winding in such a way that, in conditions of thermal stability, they have the same average temperature.

10. A device according to claim 6, wherein the said measurement resistor is made of the same electrically conductive material as the said winding.

11. A device according to claim 7, wherein the said measurement resistor has an insulating cladding for the purpose of simulating the thermal behaviour of the said winding.

12. A device according to claim 1, wherein the input to the said processor means are adapted to receive a signal indicative of the achievement of an end-of-stroke position of the said first gear wheel and are configured to control supply of the said electromagnet in such a way as to maintain the said first gear wheel in this position when this happens.

13. A device according to claim 12, wherein the said signal indicative of the achievement of the said end-of-stroke position is a signal indicative of the occurrence of supply to the said starter motor.

14. A device according to claim 13, configured in such a way as to operate with pulse width modulation.

15. A device according to claim 14, including a comparator circuit operable to control the said switch means by pulse width modulation.

16. A device according to claim 15, wherein the said comparator circuit is a comparator circuit with hysteresis.

17. A device according to claim 1, in which the said electromagnet is a coupling electromagnet for an electric starter motor for an internal combustion engine, the said processor means receiving an input signal indicating that the said internal combustion engine has started, and being configured to interrupt supply to the said electromagnet upon the occurrence of this situation.

18. A device according to claim 17, wherein the said signal indicative of starting having happened is a signal indicative of the speed of rotation of the said internal combustion engine and the said processor means are configured in such a way as to detect when a predetermined threshold value of the said speed of rotation is exceeded.

19. A device according to claim 17, wherein the said processor means are adapted to receive an input signal indicative of the temperature of the said starter motor and are configured to interrupt supply to the said electromagnet when the said temperature exceeds a predetermined threshold value.

* * * * *